US009745791B1

(12) United States Patent
Rohovit et al.

(10) Patent No.: US 9,745,791 B1
(45) Date of Patent: Aug. 29, 2017

(54) CORNER FLASHING INSERT FOR RECESSED WINDOWS

(71) Applicants: John Rohovit, Gilbert, AZ (US); John Stroup, Sierra Madre, CA (US)

(72) Inventors: John Rohovit, Gilbert, AZ (US); John Stroup, Sierra Madre, CA (US)

(73) Assignee: Top Industrial, Inc., Van Nuys, CA (US)

( * ) Notice: Subject to any disclaimer, the term of this patent is extended or adjusted under 35 U.S.C. 154(b) by 35 days.

(21) Appl. No.: 15/137,308

(22) Filed: Apr. 25, 2016

(51) Int. Cl.

| | |
|---|---|
| ***E06B 1/62*** | (2006.01) |
| ***E04B 1/68*** | (2006.01) |
| ***E06B 1/34*** | (2006.01) |
| ***E06B 1/70*** | (2006.01) |
| ***E06B 3/30*** | (2006.01) |
| ***E06B 7/26*** | (2006.01) |

(52) U.S. Cl.
CPC ..... *E06B 1/62* (2013.01); *E04B 1/6803* (2013.01); *E06B 1/34* (2013.01); *E06B 1/702* (2013.01); *E06B 3/308* (2013.01); *E06B 7/26* (2013.01); *E06B 2001/628* (2013.01)

(58) Field of Classification Search
CPC ..... E06B 1/62; E06B 7/14; E06B 6/64; E04B 1/6803; E04B 1/34; E04B 1/7002
USPC ..... 52/58
See application file for complete search history.

(56) References Cited

U.S. PATENT DOCUMENTS

| | | | | |
|---|---|---|---|---|
| 5,018,333 | A | 5/1991 | Bruhm | |
| 5,586,415 | A | 12/1996 | Fisher et al. | |
| 6,327,820 | B1 | 12/2001 | Picco | |
| 6,401,401 | B1 * | 6/2002 | Williams | E06B 1/62 49/471 |
| 6,401,402 | B1 * | 6/2002 | Williams | E06B 1/62 49/471 |
| 7,735,291 | B2 * | 6/2010 | Summy | E06B 1/62 52/302.6 |
| 7,877,940 | B2 * | 2/2011 | Meeks | E06B 1/62 49/467 |
| 8,161,689 | B1 | 4/2012 | Butzen | |
| 8,613,181 | B2 | 12/2013 | Jay et al. | |
| 9,032,688 | B2 | 5/2015 | Summy | |
| 2001/0034984 | A1 * | 11/2001 | Murphy | E06B 1/62 52/204.5 |
| 2005/0166471 | A1 * | 8/2005 | Allen | E06B 1/62 52/58 |
| 2005/0279044 | A1 * | 12/2005 | Mileti | E06B 1/62 52/580 |

(Continued)

*Primary Examiner* — Paola Agudelo
(74) *Attorney, Agent, or Firm* — Thomas I. Rozsa

(57) ABSTRACT

A corner flashing insert including a one-piece, pre-formed flashing with an outside wall, a recessed jamb leg in the vertical plane and a recessed sill leg in the horizontal plane, the recessed sill leg in the horizontal plane having a rear surface, the recessed jamb leg in the vertical plane having a first vertical height with a first distance from a top of the jamb leg in the vertical plane to the rear surface of the recessed sill leg in the horizontal plane. The corner flashing insert also includes a recessed back leg in the vertical plane having a second vertical height with a second distance from where the recessed back leg in the vertical plane joins the recessed jamb leg in the vertical plane to the rear surface of the recessed sill leg in the horizontal plane. The first vertical height is greater than the second vertical height.

23 Claims, 11 Drawing Sheets

(56) References Cited

U.S. PATENT DOCUMENTS

| | | | | |
|---|---|---|---|---|
| 2006/0010788 | A1* | 1/2006 | Nettleton | E06B 1/70 52/58 |
| 2006/0101726 | A1 | 5/2006 | Collins | |
| 2006/0260213 | A1* | 11/2006 | Williams | E06B 1/70 52/60 |
| 2007/0094957 | A1* | 5/2007 | Burton | E06B 7/14 52/209 |
| 2007/0175107 | A1 | 8/2007 | O'Rourke | |
| 2009/0090068 | A1* | 4/2009 | O'rourke | E06B 1/62 52/58 |
| 2012/0151870 | A1* | 6/2012 | Summy | E06B 1/62 52/741.4 |
| 2014/0250801 | A1* | 9/2014 | Knollmeyer | E06B 1/62 52/58 |
| 2015/0047269 | A1* | 2/2015 | Messenger | E06B 7/14 52/58 |

* cited by examiner

CORNER FLASHING INSERT FOR RECESSED WINDOWS

BACKGROUND OF THE INVENTION

1. Field of the Invention

The present invention relates in general to the field of construction of both residential and commercial structures. More specifically, the present invention relates to the field of recessed windows and problems associated with water from elements such as rain collecting in corners of areas between an exterior wall of a structure and the frame of the recessed window. The present invention further relates to the field of flashing to protect such corners from collecting water.

2. Description of the Prior Art

The construction situation addressed in this patent is as follows. In recessed window construction, an outer wall opening is flush with the exterior wall of the structure. A recessed window frame (into which a window is installed) lies in a plane behind the exterior wall and has a smaller height and width. Lower corners between the exterior wall and the recessed window frame can accumulate water from elements such as rain. Flashing has been created to attempt to seal each of these corners to prevent water from accumulating in the corners. The following set forth prior art attempts to provide such corner flashing for recessed windows.

The present inventors are aware of the following two primary patents in the field of the present invention.

U.S. Pat. No. 7,735,291 issued on Jun. 15, 2010 to Gene Summy for "Corner Flashing System" (hereafter "'291 Summy Patent");

and

U.S. Pat. No. 9,032,688 issued on May 19, 2015 to Gene Summy for "Corner Flashing System" (hereafter "'688 Summy Patent").

The '291 Summy Patents disclose a corner flashing system for sealing the corners of recessed window frames against moisture penetration. The '921 Summy Patent has thirty-one claims of invention which are all method claims. The method claims can be groups into several subdivisions, all of which claim methods which the present inventors believe have significant drawbacks:

1. Independent claim 1 requires three (3) separate flashing members to be combined. This creates time-consuming and error plagued problems. This limitation is also present in independent claims 15, and 17. Claim 2 depends from claim 1, and claims 18 through 21 directly or indirectly depend from claim 17.
2. Independent claim 5 requires two (2) separate flashing members to be combined. While an improvement over the claim 1 subgroup, it still requires time-consuming application in the field when installing this flashing. Claims 6 through 14 directly or indirectly depend from claim 5. Independent claim 16 also requires two (2) separate flashing members.
3. Independent claim 3 uses only a single flashing but requires cutting and folding a portion of the flashing to overlap a horizontal surface of an inner frame. This requires time-consuming and error prone problems in the field.

Claim 4 depends from claim 3. Independent claim 22 has the same requirements and dependent claims 23 through 31 directly or indirectly depend from claim 22.

The '988 Summy Patent is a conclusion of a long continuation prosecution history based on the parent '921 Patent. All of the claims are method claims 1. Independent claim 1 has the limitation "wherein a height of the rear seating flange as measured from the horizontal surface of the outer frame to a top edge of the rear seating flange is equal to a height of the vertical seating flange as measured from the horizontal surface of the outer frame to a top edge of the vertical seating flange." Claims 2 through 8 directly or indirectly depend from claim 1.

2. Independent claim 14 has a similar limitation as described for Claim 1, and further requires four (4) flanges. Dependent claims 15 through 17 directly or indirectly depend from claim 14.

3. Independent claim 9 requires cutting a flap so that as cut, a first flap overlaps a second flap. Dependent claim 10 depends from claim 9. Independent claim 11 requires two (2) flashing members. Independent claim 12 requires two (2) flashing members. Independent claim 13 also requires two (2) flashing members.

The inventors are also aware of the following relevant patents and published patent applications:

1. U.S. Pat. No. 5,018,333 issued to Ronald Bruhm on May 28, 1991 for "Elastomeric Weather Seal Flashing and Method of Manufacture" (hereafter the "Bruhm Patent");
2. U.S. Pat. No. 5,586,415 issued to Fred M. Fisher et al. on Dec. 24, 1996 for "Flashing Device for Use with Exterior Siding" (hereafter the "Fisher Patent");
3, U.S. Pat. No. 6,327,820 issued to Vincenzo Picco on Dec. 11, 2001 for "Kit of Elements and a Method of Using the Kit for Flashing a Roof-Penetrating Element" (hereafter the "Picco Patent");
4. United States Published Patent Application No. 2006/0010788 to William Nettleton on Jan. 19, 2006 for "Pre-Molded Corner Flashing For Use With Sealing Members" (hereafter the "Nettleton Published Patent Application");
5. United States Published Patent Application No. 2006/0101726 to P. Michael Collins on May 18, 2006 for "Sill Pan Flashing For Doors and Windows" (hereafter the "Collins Published Patent Application");
6. United States Published Patent Application No. 2007/0175107 to Barbara Kilmowicz O'Rourke on Aug. 2, 2007 for "Self-Adhered Flange for Use With Non-Flanged Windows" (hereafter the "'0175107 O'Rourke Published Patent Application");
7. United States Published Patent Application No. 2009/0090068 to Barbara Kilmowicz O'Rourke on Apr. 9, 2009 for "Self-Adhesive Corner Flashing Member and Method for Making and Using" (hereafter the "'0090068 O'Rourke Published Patent Application");
8. U.S. Pat. No. 8,161,689 issued to William J. Butzen on Apr. 24, 2012 for "Flashing End Dam Having Angularly Adjustable Leg" (hereafter the "Butzen Patent");
9. U.S. Pat. No. 8,613,181 issued to Gregory L. Jay et al. on Dec. 24, 2013 for "Apparatus and Methods for Installing a Penetration in a Sheathing Assembly" (hereafter the "Jay Patent").

The Bruhm Patent discloses a flashing primarily for a skyline structure which is different from the use of the present invention. In relevant part, this patent discloses:

> "A weatherseal flashing is made from sheet vulcanized rubber and surrounds a skylight frame situate on a roof curb. The weatherseal consists of a plurality of sealedly lapping panels each embodying a relatively wide apron and an upstanding flange extending along one elongated edge of the rectangular-shaped panel. The ends of each panel flange have overlapping sealedly connected wings on their ends to provide collectively, a continuous fastener for surrounding the inner side or leg of the skylight assembly to make a co-planar seal in engagement with the combined projecting curb and the skylight frame, and the roof surface."

The Fisher Patent discloses a flashing device for a corner of a window in which a major portion of the flashing means is held away from contact with the structure wall and in contact with a locking means of one siding panel in an orientation that causes water to be directed along a top water diverting surface of the flashing means and through drain holes in the engagement means of an adjacent panel.

The Picco Patent discloses a kit of elements and a method of using the kit for flashing a roof-penetrating element. This is primarily designed for waterproofing the corners of a skylight. Essentially this flashing is designed to surround a skylight and is therefore configured differently than the flashing of the present invention.

The Nettleton Published Patent Application discloses: a flashing member having interior flashing portions that meet at an interior corner to conform with a corner of the rough opening of a window and a membrane flashing portion intersecting each of the interior flashing portions along separate exterior corners, the interior and exterior corners intersecting at a common point. The interior corner of the opening may be sealed by placing the molded corner flashing member in the corner and then running a strip of preferably pre-creased sealing tape or other sealing member along the periphery of the wall opening and overlapping a portion of the sealing member on both the interior flashing portion and the membrane flashing portion. The flashing is not disclosed with any cutoff so it goes beyond a first buck of a recessed window.

The Colllins Published Patent Application discloses a sill pan flashing for doors and windows with components which are different from the present invention. The patent application discloses:

"A flashing system and associated method controls water and air intrusion around the sills of windows, doors, louvers and other wall penetrations. More specifically, a sheet material is creased and folded to form a sill flashing component to control water and air intrusion. Prior to this invention, a separate pre-molded termination accessory was required to effectively seal corner areas around window and door rough openings. The invention provides for sill flashing and supplemental sealing at selected joint locations prior to installation of a closure member in the opening to prevent water and air intrusion around windows, doors and other building openings."

Specifically, the patent application states:

Referring to FIGS. 1A-1B, one embodiment of the components of a sill pan flashing kit 10 is shown installed along the sill 12 and adjacent lower portions of jamb members 14 in a rough opening 16 in a wall 18 intended to receive a window frame 20, door frame (not shown) or the like. The opening 16 also includes a header 22 spaced from the sill 12 and extending between the spaced jamb members 14. While the flashing kit 10 is shown and described with respect to a window frame 20 and associated opening 16, it should be readily appreciated that the kit can be utilized for other wall openings, door thresholds and the like. As such, the term sill or variations thereof is used herein without limiting the invention to exclude door thresholds or any other application.

The '0175107 O'Rourke Published Patent Application discloses:

"An elongated flange material for forming a flange and a method for use in sealing a non-flanged window, door, or other fenestration product in a wall opening, wherein the flange material comprises at least one top coversheet and at least one bottom coversheet with a pressure-sensitive adhesive layer sandwiched between the two cover sheets, wherein the cover sheets occupy an appreciable width of the flange but do not extend across the entire width of the flange and thereby are offset with respect to each other thereby providing opposing first and second exposed surfaces of the pressures sensitive adhesive layer. Alternatively, the flange material comprises a nonporous flexible sheet with top and bottom pressure-sensitive adhesive layer on opposite sides along opposite edges of the nonporous flexible sheet."

This patent disclosure is primarily concentrating on chemical features of the product.

The '0090068 O'Rourke Published Patent Application discloses: The invention pertains to a self-adhesive corner-shaped flashing member for flashing a corner of a recessed window or other opening in a building and a method for making the member but is comprised of an entirely different method and has entirely different components from the present invention.

The Butzen Patent discloses a flashing end dam with many movable features which is different from the present invention. By way of example, this patent discloses:

"A flashing end dam having an angularly adjustable leg (adjustable end dam) includes a bottom leg, and adjustable rear leg, a side leg and a moveable web. The adjustable end dam is bent from a blank such that the bottom leg and the adjustable rear leg are formed, while bending a portion of the bottom leg and the adjustable rear leg to form the side leg and the moveable web. The adjustable end dam may be installed above a window opening in a masonry wall. The adjustable end dam is normally placed in a corner above and past the window opening. However, the adjustable end dam may be installed in any suitable application. If a nonparallel cavity variation exists between the structural wall and the exterior facing, the adjustable rear leg of the adjustable end dam may be bent back or forward to span the cavity."

The Jay Patent discloses an apparatus and method for installing a penetration in a sheathing assembly. The patent discloses:

"Apparatus and methods for installing a penetration in a sheathing assembly and building structures. An opening can be formed at least partially through a sheathing assembly that includes a body; a barrier layer; and an adhesive disposed between at least a portion of the body and the barrier layer. At least a portion of the barrier layer adjacent the opening can be peeled back to expose at least a portion of the body. A penetration can be disposed at least partially within the opening. The penetration can include a contact member that at least partially contacts the exposed body, the barrier layer, or both. The penetration can be secured to at least a portion of the sheathing assembly, and the peeled back portion of the barrier layer can be repositioned such that the barrier layer covers at least a portion of the contact member."

There is a significant need for an improved corner flashing insert for recessed windows which does have the drawbacks of the prior art methods discussed above.

SUMMARY OF THE INVENTION

The present invention is a new, novel and non-obvious one-piece, pre-formed corner window flashing insert which is used in conjunction with recessed corner framing configurations having an outside wall and a recessed window frame into which a window is installed, where lower left and right corners are formed between the outside wall in a first plane and the recessed window frame in a second vertical plane interior to the first vertical plane.

It is an object of the present invention to provide a flashing apparatus that is uniquely shaped to protect the lower corners of a structure at a location from an outside wall to a buck of a recessed window frame. There is a first or left lower corner and a second or right lower corner. The depth between an outer wall and the recessed window frame most commonly is either two (2) inches, two and a half inches (2.5) inches, or four (4) inches. The present invention has embodiments which facilitates quick and easy installation without field modification of a corner flashing insert for recessed windows which have this described depth between the outer wall and the buck of a recessed window frame.

It is also an object of the present invention to provide a one-piece, pre-formed recessed corner flashing for a recessed window structure which provides three legs of protection which are (a) the outside wall leg in a vertical plane; (b) a corner recessed leg in two planes of protection (i) a recessed jamb leg in a vertical plane, and (ii) a recessed sill leg in a horizontal plane; and (c) a recessed back leg or wall leg in a vertical plane.

It is a further object of the present invention to provide a recessed corner window flashing which further includes the recessed back leg (or wall) which is set at an angle relative to both the recessed jamb leg in the vertical plane and recessed sill leg in a horizontal plane, which angle is preferably forty-five (45) degrees to enable the insert to accommodate both a left and right corner by simply rotating the insert by ninety (90) degrees depending on which corner the insert is installed in. The angle back leg or back wall is formed to have a distance between the remote (top or horizontal) recessed leg and the angled back wall. Therefore, when installed in a corner, the vertical distance from the top of a recessed jamb leg in a vertical plane to the lower horizontal recessed shelf of a recessed window structure is greater than the vertical distance from the high point of the angle back leg to the lower horizontal recessed shelf of the recessed window structure.

It is an additional object of the present invention for the angle and dropped dimension of the recessed back leg in a vertical plane to accommodate a 1.5 inch reveal (single buck) framing configuration without field modification through a triangular shape and size.

It is also an object of the present invention for the dimension and shape of the recessed back leg in a vertical plane to optimally integrate with a sill pan end dam placed in an adjacent corner of a recessed window frame without requiring any field modification to the corner flashing insert in the majority of corner flashing inserts and sill plan end dam applications.

It is also an object of the present invention to form the corner flashing insert with a three (3) inch outside wall leg in a vertical plane and three (3) inch widths of the recessed leg in two planes (recessed jamb leg in a vertical plane and recessed sill leg in a horizontal plane) to provide optical integration into common building envelope systems with appropriate lap dimensions. This accommodates typical three (3) inch self-adhered flashing lap and weather resistive barrier lap integration.

It is additionally an object of the present invention to provide a forty-five (45) degree angle to an integration area (between vertical and horizontal portions) of the corner flashing insert outside wall leg in a vertical plane to provide improved handling and easier placement and repositioning of the outside wall leg in the corner of the recessed window structure.

The combined object of the present invention, with all the benefits as described above, is to provide a corner flashing insert which protects both inside and outside recessed corner framing configurations from water intrusion (leaks) with a single preformed recessed corner.

The present invention is described as a corner flashing insert (10) comprising: (a) a one-piece, pre-formed flashing; (b) an outside wall leg in a vertical plane (30) and an outside wall leg in a horizontal plane (50); (c) a recessed jamb leg in a vertical plane (60) and a recessed sill leg in a horizontal plane (70), the recessed sill leg in the horizontal plane having a rear surface (70-R), the recessed jamb leg in the vertical plane having a first vertical height (H-1) with a first distance from a top (60-T) of the vertical jamb leg (60) to the rear surface (70-R) of the recessed sill leg in the horizontal plane (70); (d) a recessed back leg in the vertical plane (80) set at a first angle (A) relative to the recessed sill leg in the horizontal plane (70) and set at a second angle (B) relative to the recessed jamb leg in the vertical plane (60), the recessed back leg in the vertical plane (80) having a second vertical height (H-2) with a second distance from a location where the recessed back leg in the vertical plane joins the recessed jamb leg in the vertical plane (80-H) to the rear surface (70-R) of the recessed sill leg in the horizontal plane (70), the recessed back leg in the vertical plane (80) having a rear surface (80-R); and (e) said first vertical height (H-1) greater than said second vertical height (H-2) by an extra distance, the extra distance (H-1EX) extending for a width of said recessed jamb leg in the vertical plane (60) and for a width (30-W) of said outside wall leg in a vertical plane (30).

Described broadly, the present invention is a corner flashing insert comprising: (a) a one-piece, pre-formed flashing; (b) an outside wall leg having a first portion in a vertical plane (30) and second portion in a horizontal plane (50), (c) a recessed jamb leg in the vertical plane (60) and a recessed sill leg in the horizontal plane (70), the recessed sill leg in the horizontal plane having a rear surface (70-R), the recessed jamb leg in the vertical plane having a first vertical height (H-1) with a first distance from a top (60-T) of the recessed jamb leg in a vertical plane (60) to the rear surface (70-R) of the recessed sill leg in the horizontal plane (70); (d) a recessed back leg in the vertical plane (80) set at a first angle (A) relative to the recessed sill leg in the horizontal plane and set at a second angle (B) relative to the recessed jamb leg in the vertical plane (60), the recessed back leg in the vertical plane (80) having a second vertical height (H-2) with a second distance from a location where the recessed back leg in the vertical plane (80) joins the recessed jamb leg in the vertical plane (60) to the rear surface of the recessed sill leg in the horizontal plane (70-R); and (e) the first vertical height (H-1) greater than the second vertical height (H-2).

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF EMBODIMENTS OF THE PRESENT INVENTION

Figure 1:
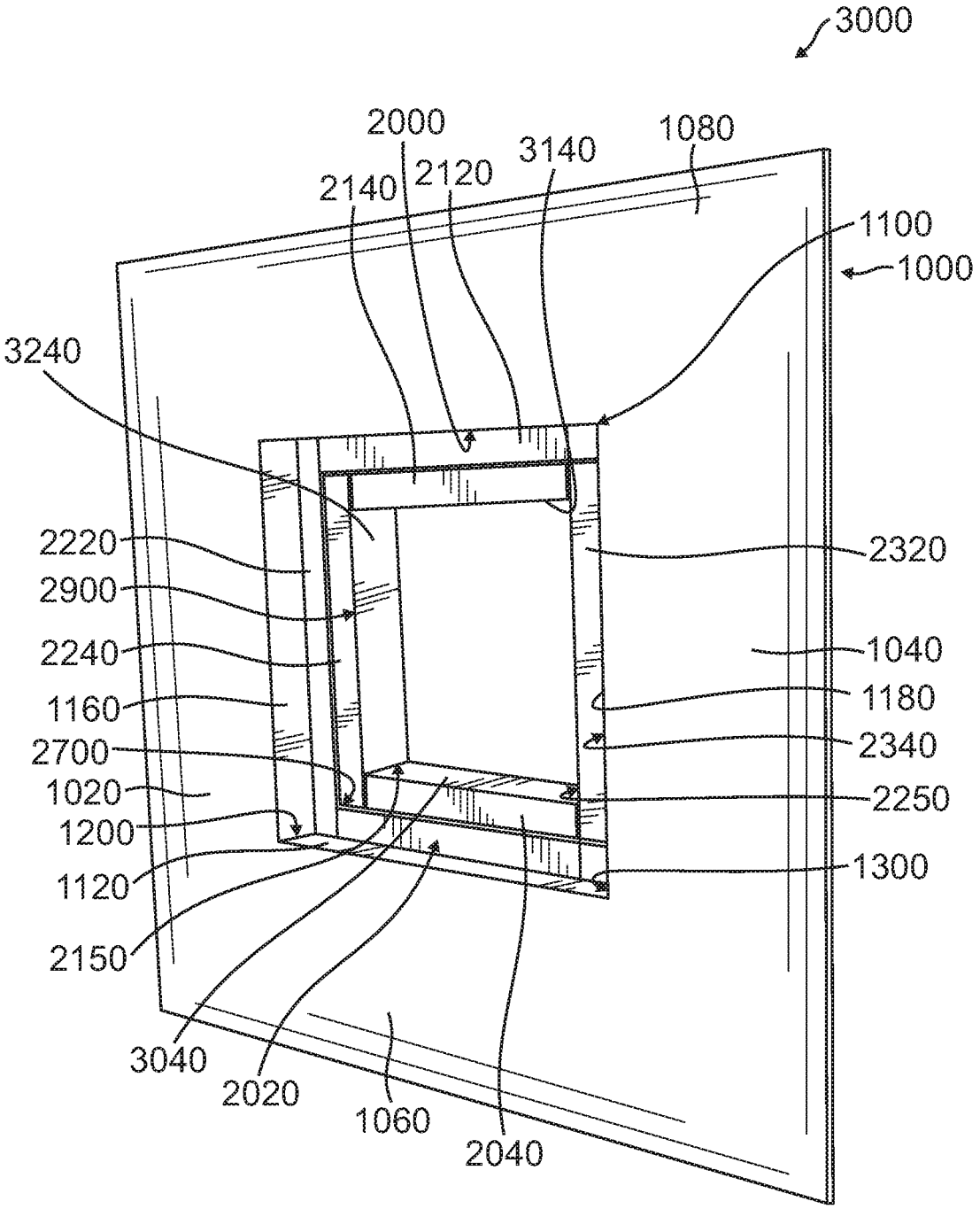
FIG. 1 is a perspective view of an example of a recessed window structure.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

PARTS LIST corner flashing insert . . . 10
outside wall leg . . . 20
rear surface of outside leg . . . 20-R
outside wall leg in a vertical plane . . . 30
rear surface of outside wall leg in a vertical plane . . . 30-R
width of outside wall leg in a vertical plane . . . 30-W
top of outside wall leg in a vertical plane . . . 30-T
outside wall leg angle . . . 40
outside wall leg angle edge . . . 40-E
rear surface of outside wall leg angle . . . 40-R
outside wall leg in a horizontal plane . . . 50
rear surface of outside wall leg in a horizontal plane . . . 50-R
recessed jamb leg in a vertical plane . . . 60
rear surface of recessed jamb leg in a vertical plane . . . 60-R
width of recessed jamb leg in a vertical plane . . . 60-W
top end of recessed jamb leg in a vertical plane . . . 60-T
recessed sill leg in a horizontal plane . . . 70
rear surface of recessed sill leg in a horizontal plane . . . 70-R
width of recessed sill leg in a horizontal plane . . . 70-W
recessed back leg (back wall) in a vertical plane . . . 80
rear surface of recessed back leg in a vertical plane . . . 80-R
angled surface of recessed back leg in a vertical plane . . . 80-AN
highest vertical pont of recessed back leg in a vertical plane. 80-H
outer wall . . . 1000
left vertical outer wall portion . . . 1020
right vertical outer wall portion . . . 1040
lower horizontal wall portion . . . 1060
upper horizontal outer wall portion . . . 1080
recessed window opening . . . 1100
recessed opening sill . . . 1120
left recessed window opening jamb . . . 1160
right recessed window opening jamb . . . 1180
left lower recessed corner . . . 1200
right lower recessed corner . . . 1300
recessed window opening head . . . 2000
lower horizontal buck #1 . . . 2020
lower horizontal buck #2 . . . 2040
upper horizontal buck #1 . . . 2120
upper horizontal buck #2 . . . 2140
lower left window corner . . . 2150
left vertical buck #1 . . . 2220
left vertical buck #2 . . . 2240
lower right window corner . . . 2250
right vertical buck #2 . . . 2320
right vertical buck #1 . . . 2340
lower left buck #1 . . . corner 2700
lower right buck #1 . . . corner 2800
window opening . . . 2900
recessed window opening structure . . . 3000
window opening sill . . . 3040
window opening head . . . 3140
left window opening jamb . . . 3240
right window opening jamb . . . 3320
sill pan end dam . . . 4000
lower angled surface of sill pan end dam or angled corner . . . 4100

DIMENSION LIST first vertical height (distance from top end of recessed jamb leg in a vertical plane (60-T) to rear surface of recessed sill leg in a horizontal plane (70-R)) . . . H-1
second vertical height (distance from highest vertical point of recessed back leg in a vertical plane (80-H) to rear surface of recessed sill leg in a horizontal plane (70-R)) . . . H-2
difference is distance between H-1 and H-2 . . . H-1EX
first angle from recessed back leg in a vertical plane (80) to recessed sill leg in a horizontal plane (70) . . . A second angle from recessed back leg in a vertical plane (80) to recessed jamb leg in a vertical plane (60) . . . B
height of first lower horizontal buck #1 . . . BH

MATERIALS LIST sealant material 1 . . . SM-1
sealant material 2 . . . SM-2
sealant material 3 . . . SM-3

Referring to FIG. 1, there is illustrated a perspective view of a recessed window opening structure 3000. Conventionally, a recessed window opening structure is a window which is positioned in a plane, primarily a vertical plane, set inwardly from an outer wall of a structure. FIG. 1 is a perspective view of an example of a recessed window opening structure 3000. The outer wall numbered 1000 is made of material which is either wood or wood and a composite. Reading clockwise beginning on the left side, the outer wall 1000 includes a left vertical outer wall portion 1020, an upper horizontal outer wall portion 1080, a right vertical outer wall portion 1040 and a lower horizontal wall portion 1060. Set within the outer wall 1000 is a recessed window opening 1100. Reading clockwise from left to right, the recessed window opening 1100 is formed with a left recessed window opening jamb 1160, an upper horizontal buck #1 (2120), a right recessed window opening jamb 1180 and a recessed opening sill 1120. For purposes on the present invention, two important corners are the left lower recessed corner 1200 where the recessed opening sill 1120 and the left recessed window opening jamb 1160 come together; and the right lower recessed corner 1300 where the recessed opening sill 1120 and right recessed window opening jamb 1180 come together.

Set interior of recessed window opening 1100, reading clockwise from left to right is, left vertical buck #1 (2220), upper horizontal buck #1 (2120), right vertical buck #1 (2340) (See FIG. 10) and lower horizontal buck #1 (2020). Set within the buck #1 members, again reading clockwise from left to right are left vertical buck #2 (2240), upper horizontal buck #2 (2140), right vertical buck #2 (2320), and lower horizontal buck #2 (2040). Set within and partially formed by the #2 buck members is the window opening 2900 including, again clockwise from left to right is the left window opening jamb 3240, the window opening head 3140, the right window opening jamb 3320 (see FIG. 10), and the window opening sill 3040. Included for discussion purposes in this application, four additional relevant corners are lower left buck #1 corner 2700 formed where lower horizontal buck #1 (2020) and left vertical buck #1 (2220) come together; and lower right buck #1 corner 2800 (see FIG. 10) formed where lower horizontal buck #1 (2020) and right vertical buck #1 (2340) (See FIG. 10) come together. Again reading clockwise from left to right are lower left window corner 2150 formed where the window opening sill 3040 and the left window opening jamb 3240 come together and the lower right window corner 2250 formed where the window opening sill 3040 and the right window opening jamb 3320 (see FIG. 1 and FIG. 10) come together.

Referring to FIGS. 2 through 9, there are illustrated the views of an embodiment of the present invention corner flashing insert for recessed windows, which has the following significant improvements:

1. The corner flashing insert 10 is a one-piece, pre-formed flashing sized to fit into the three most common sized left lower recessed corner 1200 and right lower recessed corner 1300 of a recessed window opening structure 3000.

2. The corner flashing insert 10 provides three legs of protection. The corner flashing insert 10 includes an outside wall leg 20 having a vertical portion of the outside wall leg in a vertical plane 30, an outside wall leg angle 40 with an outside wall leg angle edge 40-E, and a horizontal portion of the outside wall leg in a vertical plane 50 which are oriented in a first vertical plane when the corner flashing 10 is inserted into either left lower recessed corner 1200 or right lower recessed corner 1300. The previously described components of the outside wall leg 20 cover the outer wall 1000 at the location adjacent the left lower recessed corner 1200 and/or the right lower recessed corner 1300 of a recessed window opening structure 3000.

Figure 10:
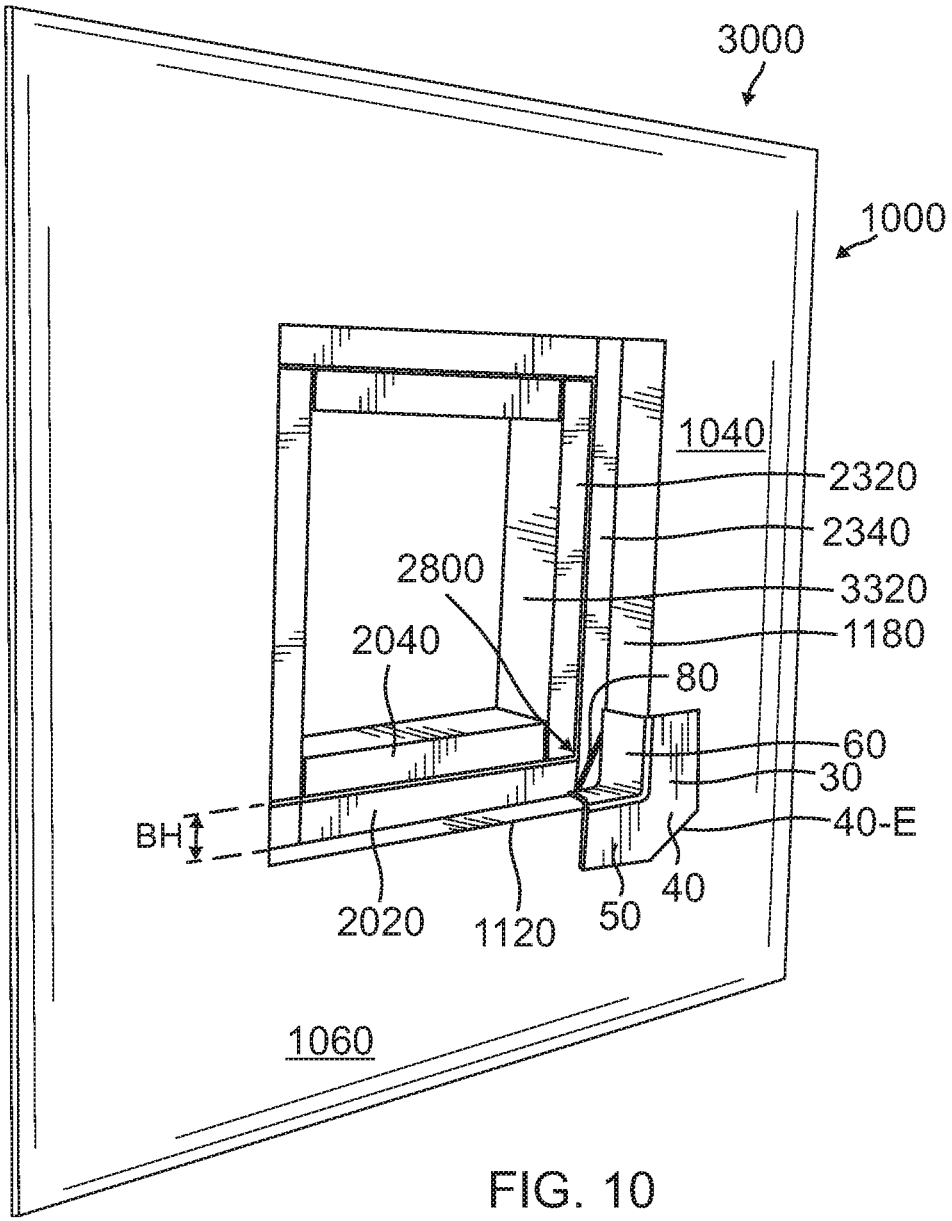
FIG. 10 is a perspective view of the embodiment of the present invention corner flashing insert illustrated in FIG. 2 inserted into the second or lower right side corner of the recessed window structure illustrated in FIG. 1.
Figure 11:
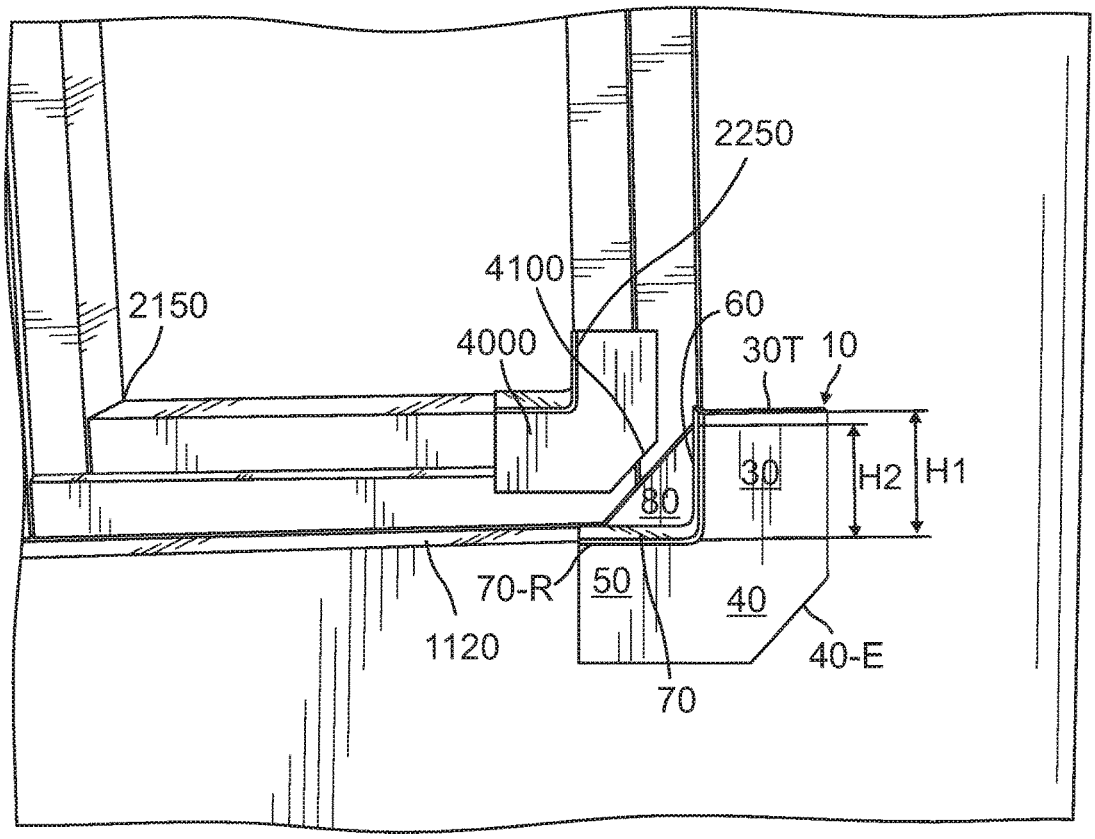
FIG. 11 is a front elevational view of the embodiment of the present invention corner flashing insert illustrated in FIG. 2 inserted into the second or lower right side corner of the recessed window structure illustrated in FIG. 1.
Figure 12:
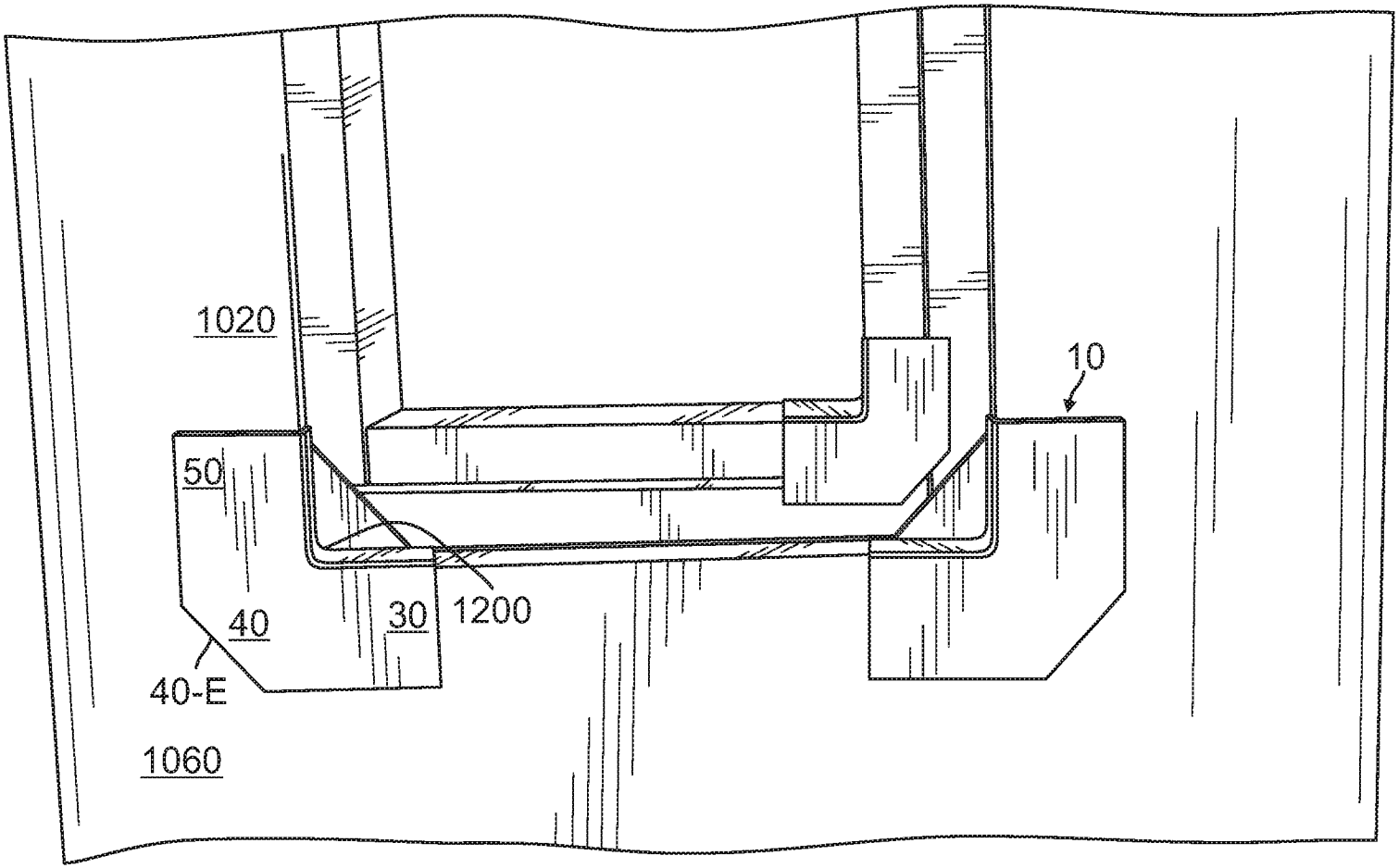
FIG. 12 is a front elevational view of the embodiment of the present invention corner flashing insert illustrated in FIG. 2 rotated ninety (90) degrees in the clockwise direction inserted into the first or lower left side corner of the recessed window structure illustrated in FIG. 1.

When used as an insert in right lower recessed corner 1300 as illustrated in FIGS. 10 and 11, the outside wall leg in a vertical plane 30 serves to cover the right vertical outer wall portion 1040 and the outside wall leg in a horizontal plane 50 serves to cover the lower horizontal wall portion 1060. The outside wall leg angle 40 covers an integration area. The angled portion of outside wall leg angle 40 is preferably cut at a forty-five (45) degree angle at its outside wall leg angled edge 40-E relative to outside wall leg in a vertical plane 30 and outside wall leg in a horizontal plane 50. This outside wall leg angle edge 40-E makes the corner flashing insert easier to place and remove for adjustment. If used as an insert in left lower recessed corner 1200, the corner flashing insert 10 is rotated ninety (90) degrees clockwise from the view in FIG. 4 and inserted into left lower recessed corner 1200 as illustrated in FIG. 12. In the application when rotated ninety (90) degrees clockwise, outside wall leg in a vertical plane 30 serves to cover the lower horizontal wall portion 1060 and the outside wall leg in a horizontal plane 50 serves to cover the left vertical outer wall portion 1020 and the outside wall leg angle 40 covers an integration area.

Figure 2:
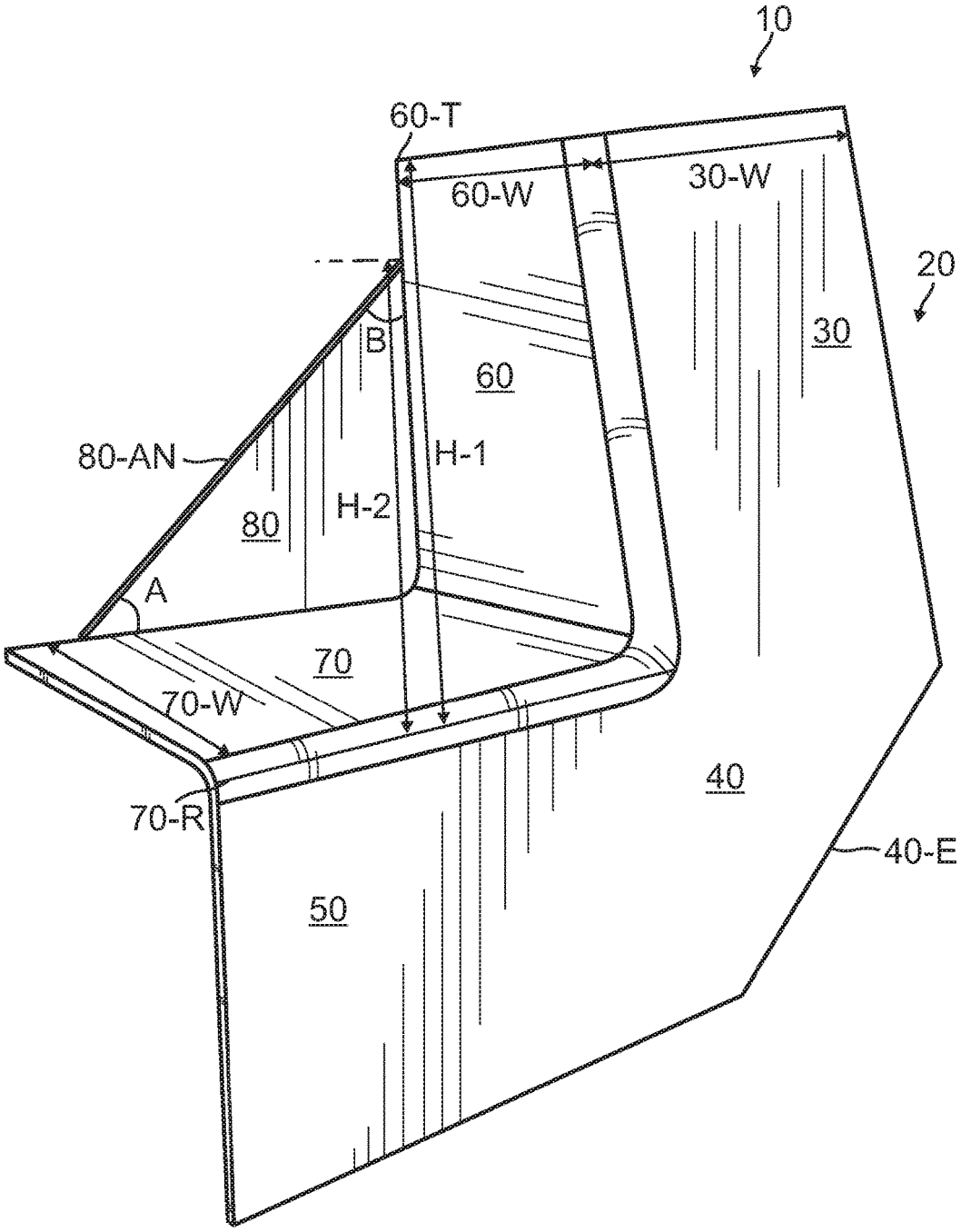
FIG. 2 is a front perspective view of an embodiment of the present invention corner flashing insert.
Figure 4:
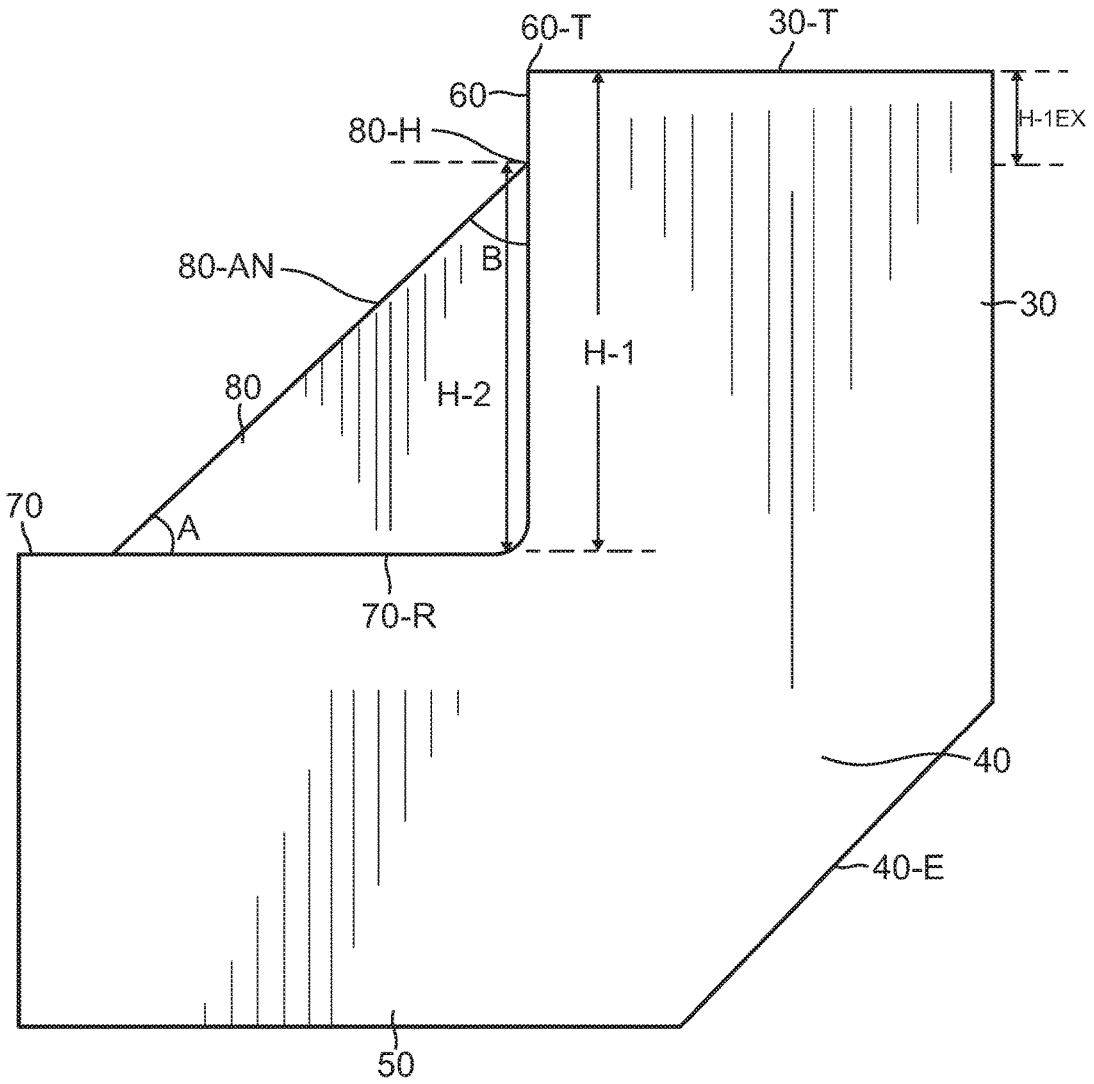
FIG. 4 is a front elevational view of the embodiment of the present invention corner flashing insert illustrated in FIG. 2.

3. The second leg of protection is the recessed leg in two planes. Referring to FIGS. 2 and 4, this includes a recessed jamb leg in a vertical plane 60, and a recessed sill leg in a horizontal plane 70. When used as an insert in right lower recessed 1300 as illustrated in FIGS. 10 and 11, the recessed jamb leg in a vertical plane 60 covers the right recessed window opening jamb 1180 at the location of the right lower recessed corner 1300. The recessed sill leg in a horizontal plane 70 covers the recessed opening sill 1120 at the location of the right lower recessed 1300.

When used as an insert in left lower recessed corner 1200, the corner flashing insert 10 is rotated by 90 degrees clockwise and placed in that corner. The parts are numbered in FIG. 5 to show how it would appear when placed in the lower left recessed corner. The parts 30, 40 and 50 have remained the same but they are located at different portions against the window structure.

4. The third leg of protection is the recessed back leg in a vertical plane 80. The recessed back leg in a vertical plane 80 is preferably set at a forty-five (45) degree angle "A" relative to recessed sill leg in a horizontal plane 70 and a forty-five degree angle "B" relative to recessed jamb leg in a vertical plane 60 and has an angled surface 80-AN. The recessed back leg in a vertical plane 80 covers a portion of lower horizontal buck #1 (2020) but does not extend by a sufficient distance to reach lower horizontal buck #2 (2040). The recessed back leg in a vertical plane 80 functions this way at either corner 1200 and 1300.

5. The angle and dropped dimension of the recessed back leg in a vertical plane 80 accommodate what is conventionally referred to and called a 1.5 inch reveal (single buck) framing configuration without field modification through its triangular shape and size. Also, as illustrated in FIG. 11, when a sill plan end dam 4000 is installed in a lower right window corner 2250, which is proximate to right lower recessed corner 1300, the dimension and shape of the recessed back leg in a vertical plane 80 does not touch the sill pan end dam 4000 or its angled corner 4100 and therefore optimally integrates the sill pan end dam without field modification in the majority of sill pan applications.

The lower right window corner 2250 is the intersection where window opening sill 3040 and right window opening jamb 3320 intersect. Lower left window corner 2150 is the location where window opening sill 3040 and left window opening jamb 3240 intersect.

Figure 4A:
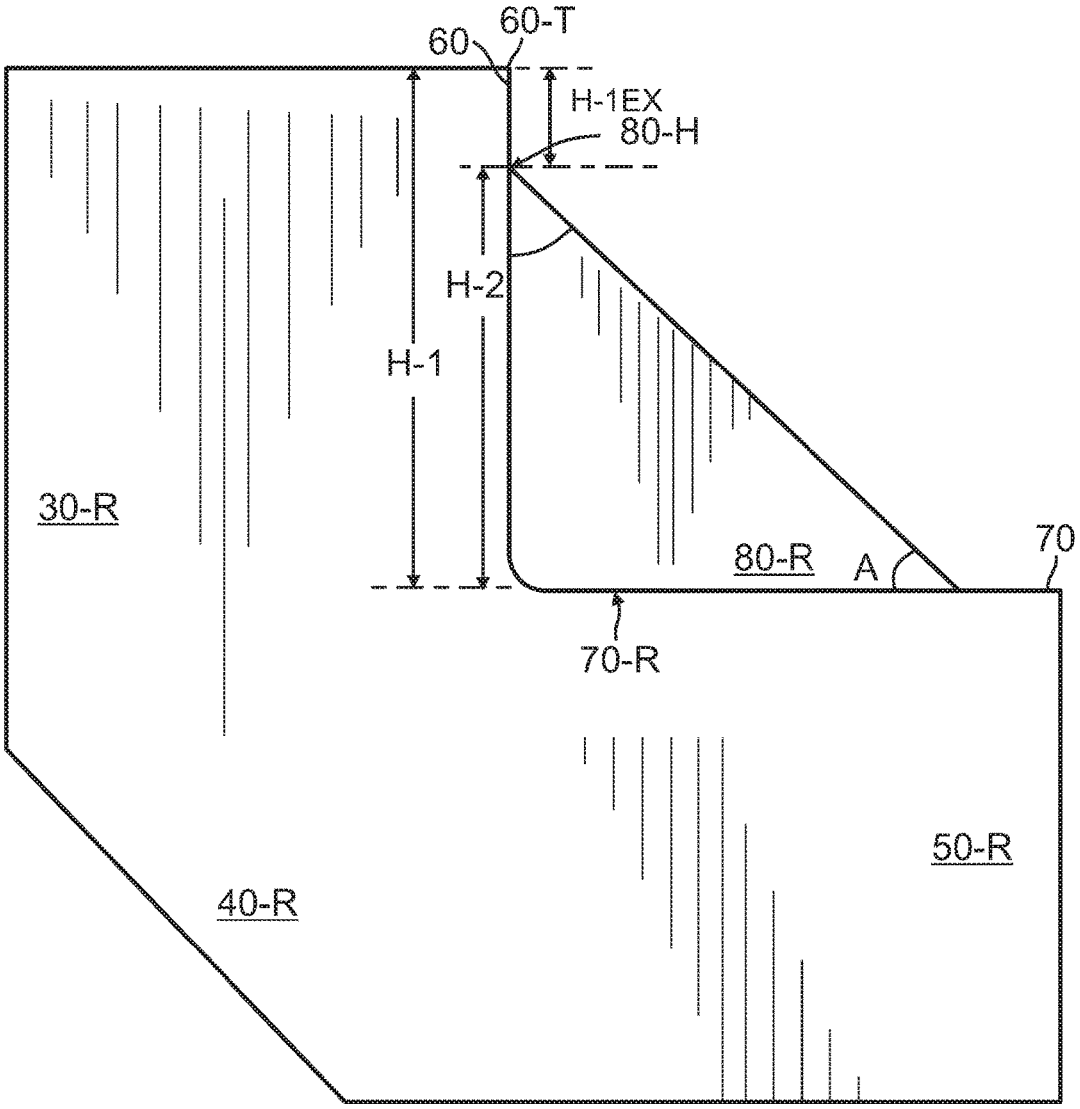
FIG. 4A is a rear elevational view of the embodiment of the present invention corner flashing insert illustrated in FIG. 4, illustrated by rotating the corner flashing insert illustrated in FIG. 4 by 180 degrees into the paper in a clockwise direction so that the same view of the corner flashing is viewed from the rear and not from the front as illustrated in FIG. 4.
Figure 5:
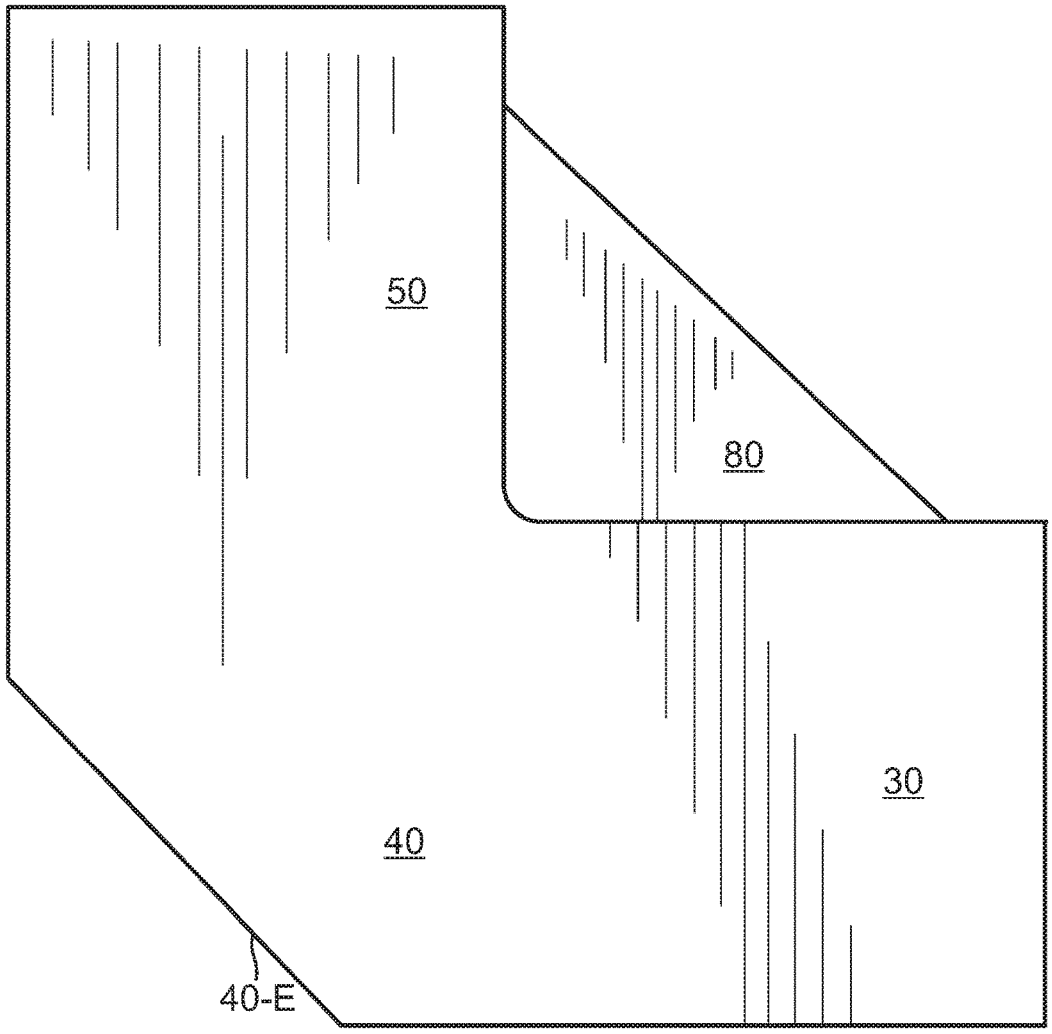
FIG. 5 is a front elevational view of the embodiment of the present invention corner flashing insert illustrated in FIG. 2 rotating the corner flashing insert by 90 degrees in a clockwise direction.
Figure 6:
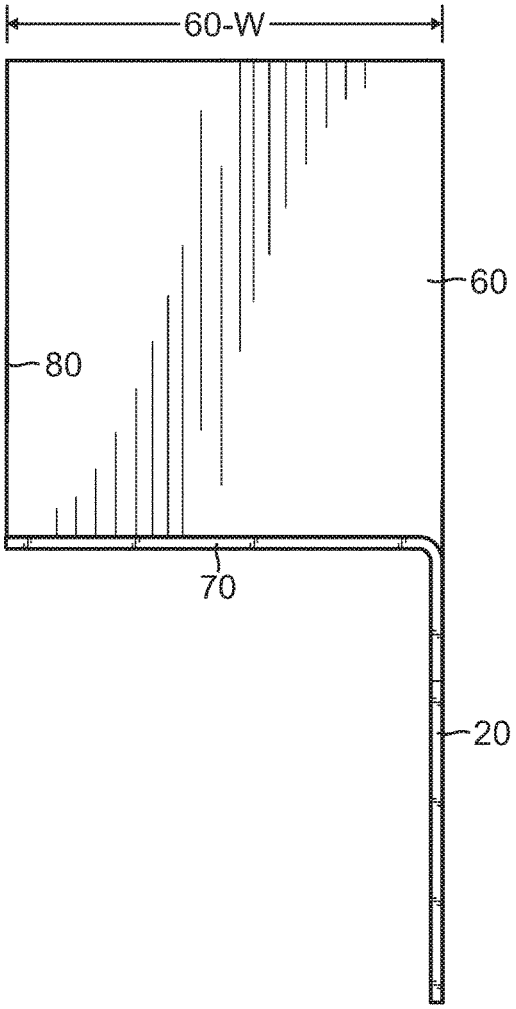
FIG. 6 is a left side view of the embodiment of the present invention corner flashing insert illustrated in FIG. 2.
Figure 7:
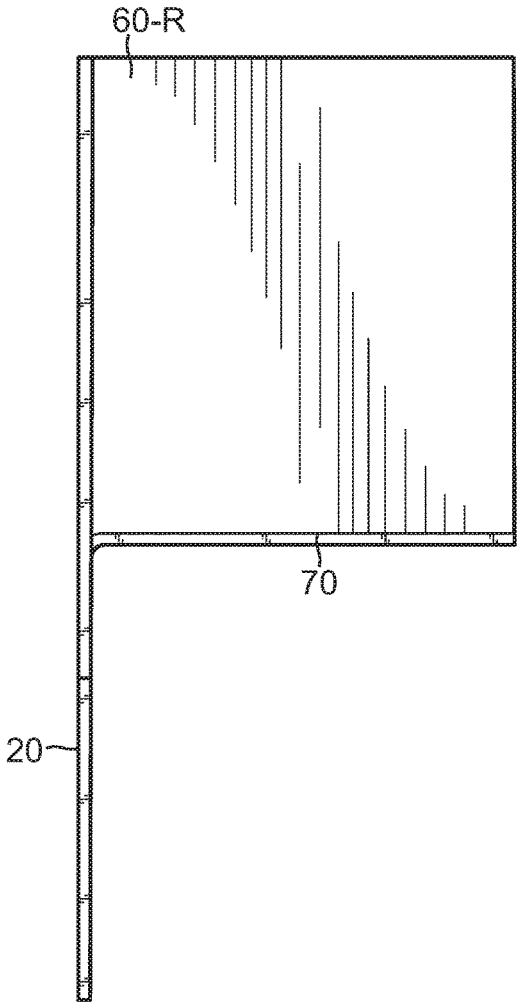
FIG. 7 is a right side view of the embodiment of the present invention corner flashing insert illustrated in FIG. 2.
Figure 8:
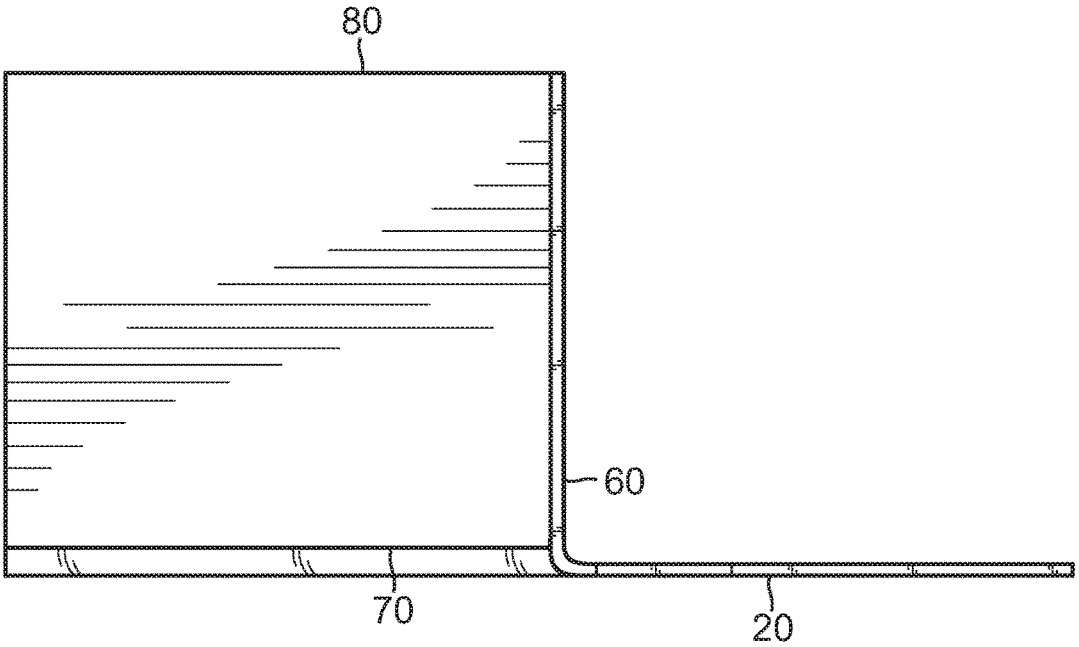
FIG. 8 is a top view of the embodiment of the present invention corner flashing insert illustrated in FIG. 2.
Figure 9:
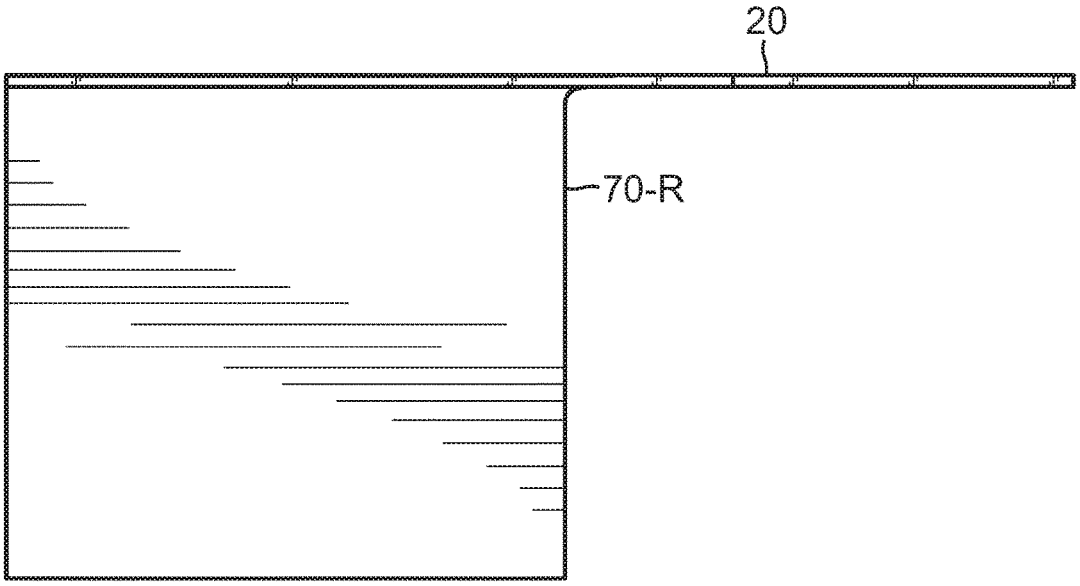
FIG. 9 is a bottom view of the embodiment of the present invention corner flashing insert illustrated in FIG. 2.

6. FIGS. 2, 4 and 4A provides several important dimensions. The most important dimensions are H-1 which is the distance from the top end of recessed jamb leg in a vertical plane 60-T to the recessed opening sill 1120.

As illustrated in FIG. 11, when the corner flashing insert 10 is installed in a lower recessed corner, the rear surface 70-R of the recessed sill leg in a horizontal plane 70 touches the recessed opening sill 1120. Therefore, for purposes of computing and describing H-1 and H-2 referring only to the corner flashing insert 10 and not using the portions of the recessed window structure 3000, H-1 is also the distance from the top of recessed jamb leg in a vertical plane 60-T to the rear surface of the recessed sill leg in a horizontal plane 70-R; and H-2 is also the distance from the highest vertical point of recessed back leg in a vertical plane 80-H to the rear surface 70-R of the recessed sill leg in a horizontal plane. H-1 is greater than H-2.

The distance by which H-1 is greater than H-2 is numbered H-1EX. The extra distance H-1EX which extends for the entire width 60-W of recessed jamb leg in a vertical plane 60 and the width of outside wall leg in a vertical plane 30-W of corner flashing insert 10 provides extra strength for corner flashing insert 10 and provides more interior surface for sealant material, if desired, while at the same time not impacting the recessed back leg in a vertical plane 80.

Figure 3:
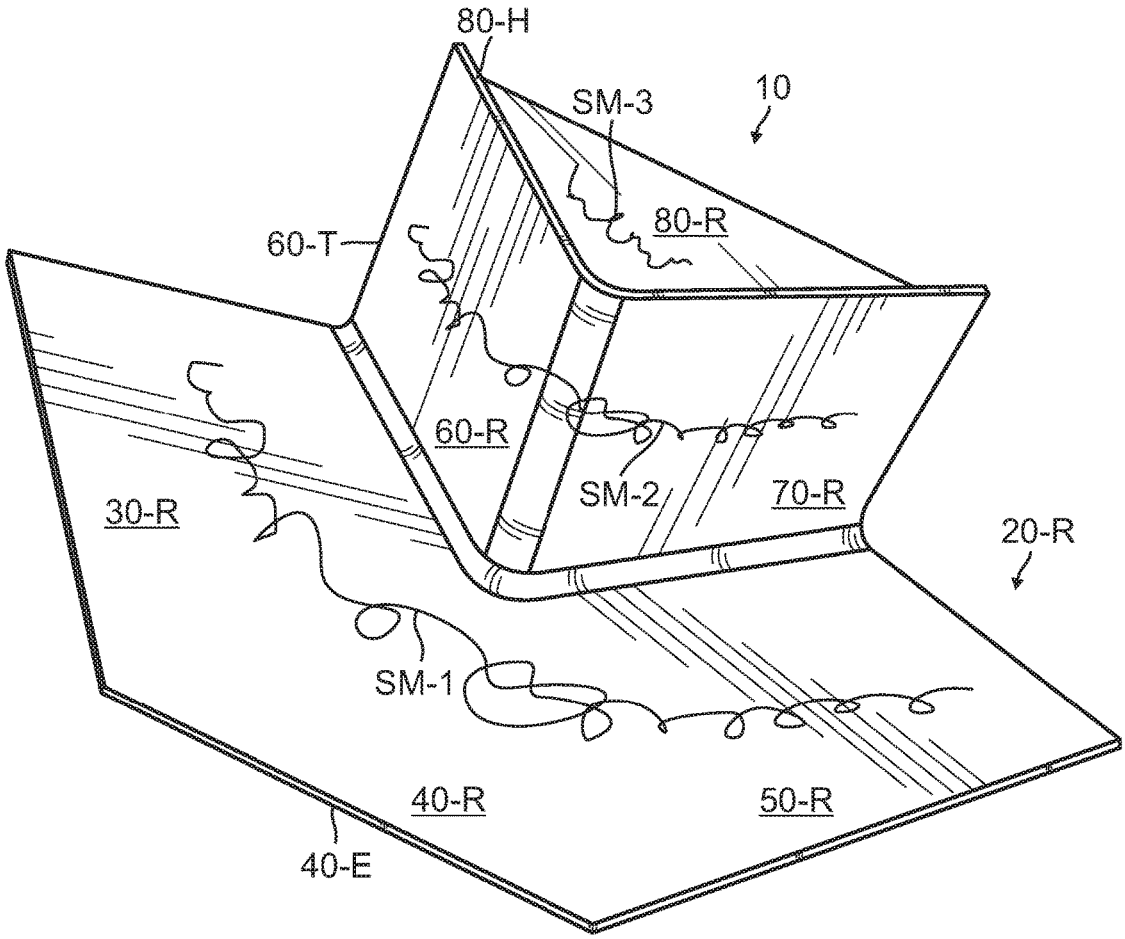
FIG. 3 is a rear perspective view also rotated ninety (90) degrees of the embodiment of the present invention corner flashing insert illustrated in FIG. 2.

7. As illustrated in FIG. 3, sealant material SM-1 is applied to the rear surface 20-R of corner flashing insert 10, including rear surface 30-R of outside wall leg in a vertical plane 30, rear surface 40-R of outside wall leg angle 40, and rear surface 50-R of outside wall leg in a horizontal plan 50. It is also within the spirit and scope of the present invention for the sealant material SM-1 to be applied to corresponding location on the right vertical outer wall portion 1040 and lower horizontal wall portion 1060. If the corner flashing insert 10 is inserted in the left lower corner 1200, then the sealant material SM-1 can also be applied to the left vertical outer wall portion 1020 and the lower horizontal wall portion 1060. The sealant material SM-1 illustrated in FIG. 3 is for illustrative purposes and can be applied in any desired manner. It is within the spirit and scope of the present invention to apply the sealant material to either or both the outer wall and/or the corner flashing insert, as described. It is also within the spirit and scope of the present invention to not apply any sealant at any location or to apply sealant at some of the locations and not other of the locations as discussed above.

Similarly, sealant material SM-2 is applied to the rear surface 60-R of recessed jamb leg in a vertical plane 60 and to the rear surface 70-R of recessed sill leg in a horizontal plane 70 as illustrated in FIG. 3. It is also within the spirit and scope of the present invention for the sealant material SM-2 to be applied to corresponding locations on the recessed opening sill 1120 and right recessed window opening jamb 1180; or alternatively, if placed in the opposite corner location, then the adhesive material SM-2 can be applied to corresponding locations on the left recessed window opening jamb 1160 and the recessed window opening sill 1120. The sealant material SM-2 illustrated in FIG. 3 is for illustrative purpose and can be applied in any desired manner. It is within the spirit and scope of the present invention to apply the sealant material to either or both the recessed portions of the recessed window structure 3000 and/or the corner flashing insert, as described.

Similarly, sealant material SM-3 is applied to the rear surface 80-R of recessed back leg in a vertical plane 80 as illustrated in FIG. 3. It is also within the spirit and scope of the present invention for the sealant material SM-3 to be applied to corresponding locations on the lower horizontal buck #1 (2020) and on the right vertical buck #1 (2340). The corresponding locations applied to the left lower recessed corner 1200 also apply. In this case, in addition to applying the sealant to the left of the lower horizontal buck #1 (2020), it would also be applied to the left vertical buck #1 (2220) or right vertical buck #1 (2340) depending upon the placement of the present invention. The sealant material SM-3 illustrated in FIG. 3 is for illustrative purpose and can be applied in any desired manner. It is within the spirit and scope of the present invention to apply the sealant material to either or both the buck areas as described and/or the corner flashing insert, as described.

The identified sealant material SM-1, SM-2 and SM-3 can be the same sealant or different sealants and is/are conventional sealant material used to retain corner flashing inserts to portions of a recessed window structure. It is within the spirit and scope of the present invention to have sealants selected from the group consisting of SM-1, SM-2 and SM-3 or alternatively, to not include any of the sealants.

8. The corner flashing insert 10 is made out of water impervious material selected from the group consisting of low density polyethylene and high density polyethylene. The corner flashing insert 10 is also transparent. The corner flashing insert 10 is also opaque. It is also within the spirit and scope of the present invention to include other materials not identified herein for the material out of which the corner flashing insert is made.

The components of the present invention corner flashing insert have been labeled with the letter "a" before each component. However, when described in a claim where the component has been previously described, it is within the spirit and scope of the present invention to describe each component with the word "the". Therefore, when used in conjunction with a recessed window structure, one description of the present invention is: A corner flashing insert (10) used in conjunction with a recessed window opening structure (3000) including at least an outer wall (1000) in a first vertical plane having at least a vertical outer wall portion (1040) and a horizontal wall portion (1060), a window opening (2900) in a second vertical plane, at least a lower horizontal buck #1 (2020) having a given vertical height (BH), the second vertical plane at a location interior to said first vertical plane, between the outer wall (1000) and the window opening (2900) are a recessed opening sill (1120) and a recessed window opening jamb (1180) forming a lower interior recessed corner (1300), the corner flashing insert (10) comprising: (a) a one-piece, pre-formed flashing; (b) an outside wall leg in a vertical plane (30), the outside wall leg in the vertical plane having a rear surface 30-R, an outside wall leg angle (40), the outside wall leg angle having a rear surface (40-R), an outside wall leg in a horizontal plane (50), and the outside wall leg in the horizontal plane having a rear surface (50-R); (c) a recessed jamb leg in a vertical plane (60) and a recessed sill leg in the horizontal plane (70), the recessed sill leg in a horizontal plane having a rear surface (70-R), the recessed jamb leg in the vertical plane having a rear surface (60-R) and having a first vertical height (H-1) with a first distance from a top (60-T) of the recessed jamb leg in a vertical plane (60) to the rear surface (70-R) of the recessed sill leg in the horizontal plane (70); (d) a recessed back leg in the vertical plane (80) set at a first angle (A) relative to the recessed sill leg in the horizontal plane (70) and set at a second angle (B) relative to the recessed jamb leg in the vertical plane (60), the recessed back leg in the vertical plane (80) having a having a second vertical height (H-2) with a second distance from a location where the recessed back leg in the vertical plane joins the recessed jamb leg in the vertical plane (60) to the rear surface (70-R) of the recessed sill leg in the horizontal plane (70), the recessed back leg in the vertical plane (80) having a rear surface (80-R); (e) said first vertical height (H-1) greater than said second vertical height (H-2) by an extra distance (H-1EX), the extra distance extending for a width (60-W) of said recessed jamb leg in the vertical plane (60) and for a width (30-W) of said outside wall leg in a vertical plane (30); and (f) said second vertical height (H-2) less than said vertical height (BH) of said lower horizontal buck #1 (2020); (g) whereby, when said corner flashing insert (10) is affixed to said lower recessed corner (1130), the rear surface (30-R) of said outside wall leg in a vertical plane (30) covers said vertical outer wall portion (1040) of said outer wall (1000) at a location adjacent said lower recessed corner (1300) and the rear surface (50-R) of said outside wall leg in a horizontal plane (50) covers said lower horizontal portion (1060) of outer wall (1000) at the location adjacent said lower recessed corner (1300), said recessed jamb leg in the vertical plane (60) covers said recessed window opening jamb (1180) at the location adjacent the lower recessed corner (1300), said recessed sill leg in the horizontal plane (70) covers said recessed opening sill (1120) at the location adjacent said lower recessed corner (1300), said recessed back leg in the vertical plane (80) covers a portion of the lower horizontal buck #1 (2020) and does extend over the height (BH) of the lower horizontal buck #1, to thereby provide waterproof protection to prevent water from accumulating at a location of the lower recessed corner (1300).

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A corner flashing insert adapted for use only with a recessed window opening structure including at least an outer wall in a first vertical plane having at least a vertical outer wall portion and at least a horizontal wall portion, a recessed window opening in a recessed window vertical plane, at least a lower horizontal buck #1 having a buck vertical height, the recessed window vertical plane at a location interior to said first vertical plane, between the outer wall and the recessed window opening is a recessed opening sill in a horizontal plane and a recessed window opening jamb in a second vertical plane forming a lower recessed corner, the corner flashing insert comprising:

a. an outside wall leg in said first vertical plane including:
(i) a vertical portion with a rear surface,
(ii) an outside wall leg angle having a rear surface, and
(iii) a horizontal portion having a rear surface;

b. a recessed jamb leg in said second vertical plane and a recessed sill leg in said horizontal plane, the recessed sill leg in the horizontal plane having a rear surface, the recessed jamb leg in the second vertical plane having a rear surface and having a first vertical height with a first distance from a top of the recessed jamb leg in the second vertical plane to the rear surface of the recessed sill leg in the horizontal plane;

c. a triangular shaped recessed back leg in a third vertical plane having an angled surface extending from a first back leg location where the angled surface joins the recessed sill leg in the horizontal plane to a second back leg location where the angled surface joins the recessed jamb leg in the second vertical plane, the triangular shaped recessed back leg having a first angle less than ninety (90) degrees relative to the recessed sill leg in the horizontal plane at the first back leg location and having a second angle less than ninety (90) degrees relative to the recessed jamb leg in the second vertical plane at the second back leg location, the triangular shaped back leg having a second vertical height extending from the second back leg location to the rear surface of the recessed sill leg in the horizontal plane, the triangular shaped recessed back leg in the third vertical plane having a rear surface;

d. said angled surface of said triangular shaped recessed back leg in the third vertical plane sized and adapted to not extend into said recessed window opening;

e said first vertical height greater than said second vertical height by an extra distance, the extra distance extending for a width of said recessed jamb leg in the second vertical plane and further extending for a width of said vertical portion of said outside wall leg in said first vertical plane;

f. a combination of said outside wall leg in said first vertical plane, said recessed jamb leg in said second vertical plane, said recessed sill leg in said horizontal plane and said triangular-shaped recessed back leg in said third vertical plane form the corner flashing insert in one piece;

g. whereby, when said corner flashing insert is affixed to the lower recessed corner, the rear surface of said vertical portion of said outside wall leg in a vertical plane covers said vertical outer wall portion of said outer wall at a location adjacent said lower recessed corner and the rear surface of said horizontal portion of said outside wall in said first vertical plane covers a lower horizontal portion of said outer wall at the location adjacent said lower recessed corner, said recessed jamb leg in the second vertical plane covers said recessed window opening jamb at the location adjacent the lower recessed corner, said recessed sill leg in the horizontal plane covers said recessed opening sill at the location adjacent said lower recessed corner, the rear surface of said triangular shaped recessed back leg in the third vertical plane covers at least a portion of said horizontal buck #1 to thereby provide waterproof protection to prevent water from accumulating at a location of the lower interior recessed corner.

2. The corner flashing insert in accordance with claim 1, wherein a. said first angle is forty-five (45) degrees; and b. said second angle is forty-five (45) degrees.

3. The corner flashing insert in accordance with claim 1, wherein said corner flashing insert is made out of water impervious material selected from the group consisting of low density polyethylene, high density polyethylene, and combinations of low density polyethylene and high density polyethylene.

4. The corner flashing insert in accordance with claim 1, wherein a. said recessed jamb leg in the second vertical plane having a width of two (2) inches; and b. said recessed sill leg in the horizontal plane having a width of two (2) inches.

5. The corner flashing insert in accordance with claim 1, wherein a. said recessed jamb leg in the vertical plane having a width of two and one-half (2-½) inches; and b. said recessed sill leg in the horizontal plane having a width of two and one-half (2-½) inches.

6. The corner flashing insert in accordance with claim 1, wherein a. said recessed jamb leg in the vertical plane having a width of four (4) inches; and b. said recessed sill leg in the horizontal plane having a width of four (4) inches.

7. A corner flashing insert adapted for use only with a recessed window opening structure in accordance with claim 1 and a sill pan end dam with a lower angled surface affixed to a lower corner of said recessed window opening with a lower angled surface of the sill pan end dam facing a proximate lower recessed corner; whereby said angled surface of said triangular shaped recessed back leg in the third vertical plane sized and adapted to not extend into said recessed window opening; avoids interference between said corner flashing insert and a sill pan end dam.

8. A corner flashing insert adapted for use only with a recessed window opening structure including at least an outer wall in a first vertical plane having at least a vertical outer wall portion and at least a horizontal wall portion, a recessed window opening in a recessed window vertical plane, the recessed window vertical plane at a location interior to said first vertical plane, between the outer wall and the recessed window opening is a recessed opening sill in a horizontal plane and a recessed window opening jamb in a second vertical plane forming a lower recessed corner, the corner flashing insert comprising:

a. an outside wall leg in said first vertical plane including:
(i) a vertical portion with a rear surface, and
(ii) a horizontal portion having a rear surface;

b. a recessed jamb leg in said second vertical plane and a recessed sill leg in said horizontal plane, the recessed sill leg in the horizontal plane having a rear surface, the recessed jamb leg in the second vertical plane having a rear surface and having a first vertical height with a first distance from a top of the recessed jamb leg in the second vertical plane to the rear surface of the recessed sill leg in the horizontal plane;

c. a triangular-shaped recessed back leg in a third vertical plane having an angled surface extending from a first back leg location where the angled surface joins the recessed sill leg in the horizontal plane to a second back leg location where the angled surface joins the recessed jamb leg in the second vertical plane, the triangular shaped recessed back leg having a first angle less than ninety (90) degrees relative to the recessed sill leg in the horizontal plane at the first back leg location and having a second angle less than ninety (90) degrees relative to the recessed jamb leg in the second vertical plane at the second back leg location; the triangular shaped back leg having a second vertical height extending from the second back leg location to the rear surface of the recessed sill leg in the horizontal plane, the triangular shaped recessed back leg in the third vertical plane having a rear surface;

d said first vertical height greater than said second vertical height by an extra distance; and e. a combination of said outside wall leg in said first vertical plane, said recessed jamb leg in said second vertical plane, said recessed sill leg in said horizontal plane and said triangular shaped recessed back leg in said third vertical plane form the corner flashing insert in one piece;

f. whereby, when said corner flashing insert is affixed to a lower recessed corner, the rear surface of said vertical portion of said outside wall leg in a vertical plane covers said vertical outer wall portion of said outer wall at a location adjacent said lower recessed corner and the rear surface of said horizontal portion of said outside wall in said first vertical plane covers a lower horizontal portion of said outer wall at the location adjacent said lower recessed corner, said recessed jamb leg in the second vertical plane covers said recessed window opening jamb at the location adjacent the lower recessed corner, said recessed sill leg in the horizontal plane covers said recessed opening sill at the location adjacent said lower recessed corner, and said rear surface of said triangular shaped recessed back in the third vertical plane covers at least a portion of said horizontal buck #1 to thereby provide waterproof protection to prevent water from accumulating at a location of the lower interior recessed corner.

9. A corner flashing insert adapted for use only with a recessed window opening structure in accordance with claim 8 and having at least a lower horizontal buck #1 having a buck vertical height and a sill pan end dam with a lower angled surface affixed to a recessed window opening corner with the lower angled surface of the sill pan end dam facing a proximate interior recessed corner, the corner flashing insert further comprising:

a. said angled surface of said triangular shaped recessed back leg in the third vertical plane sized and adapted to not extend into said recessed window opening;

b. whereby said angled surface of said triangular shaped recessed back leg in the third vertical plane sized and adapted to not extend into said recessed window opening avoids interference between said corner flashing insert and said sill pan end dam.

10. The corner flashing insert in accordance with claim 8, wherein a. said first angle is forty-five (45) degrees; and b. said second angle is forty-five (45) degrees.

11. The corner flashing insert in accordance with claim 8, wherein said corner flashing insert is made out of water impervious material selected from the group consisting of low density polyethylene, high density polyethylene and combinations of low density polyethylene, and high density polyethylene.

12. The corner flashing insert in accordance with claim 8, wherein a. said recessed jamb leg in the second vertical plane having a width of two (2) inches; and b. said recessed sill leg in the horizontal plane having a width of two (2) inches.

13. The corner flashing insert in accordance with claim 8, wherein a. said recessed jamb leg in the vertical plane having a width of two and one-half (2-½) inches; and b. said recessed sill leg in the horizontal plane having a width of two and one-half (2-½) inches.

14. The corner flashing insert in accordance with claim 8, wherein a. said recessed jamb leg in the vertical plane having a width of four (4) inches; and b. said recessed sill leg in the horizontal plane having a width of four (4) inches.

15. A corner flashing insert adapted for use only with a recessed window opening structure, the corner flashing insert comprising:

a. an outside wall leg in a first vertical plane including:
(i) a vertical portion having a rear surface, and
(ii) a horizontal portion having a rear surface;

b. a recessed jamb leg in a second vertical plane and a recessed sill leg in a horizontal plane, the recessed sill leg in the horizontal plane having a rear surface, the recessed jamb leg in the second vertical plane having a rear surface and having a first vertical height with a first distance from a top of the recessed jamb leg in the second vertical plane to the rear surface of the recessed sill leg in the horizontal plane;

c. a triangular-shaped recessed back leg in a third vertical plane having an angled surface extending from a first back leg location where the angled surface joins the recessed sill leg in the horizontal plane to a second back leg location where the angled surface joins the recessed jamb leg in the second vertical plane, the triangular-shaped recessed back leg in the third vertical plane having a first angle less than ninety (90) degrees relative to the recessed sill leg in the horizontal plane at the first back leg location and having a second angle less than ninety (90) degrees relative to the recessed jamb leg in the second vertical plane at the second back leg location, the triangular-shaped recessed back leg in the third vertical plane having a second vertical height extending from the second back leg location to the rear surface of the recessed sill leg in the horizontal plane, said triangular-shaped recessed back leg in the third vertical plane having a rear surface;

d said first vertical height greater than said second vertical height by an extra distance; and e. a combination of said outside wall leg in said first vertical plane, said recessed jamb leg in said second vertical plane, said recessed sill leg in said horizontal plane and said triangular-shaped recessed back leg in said third vertical plane form the corner flashing insert in one piece.

16. The corner flashing insert adapted for use only with a recessed window opening structure in accordance with claim 15, wherein said outside wall leg in a first vertical plane further includes an outside wall leg angle having a rear surface.

17. The corner flashing insert adapted for use only with a recessed window opening structure in accordance with claim 15, wherein said extra distance of said first vertical height greater than said second vertical height extending for a width of said recessed jamb leg in said second vertical plane and further extending for a width of said vertical portion of said outside wall leg in a first vertical plane.

18. The corner flashing insert adapted for use only with a recessed window opening structure in accordance with claim 15, wherein said corner flashing insert is made out of water impervious material selected from the group consisting of low density polyethylene, high density polyethylene and combinations of low density polyethylene and high density polyethylene.

19. The corner flashing insert adapted for use only with a recessed window opening structure in accordance with claim 15, wherein a. said first angle is forty-five (45) degrees; and b. said second angle is forty-five (45) degrees.

20. The corner flashing insert adapted for use only with a recessed window opening structure in accordance with claim 15, wherein a. said recessed jamb leg in the second vertical plane having a width of two (2) inches; and b. said recessed sill leg in the horizontal plane having a width of two (2) inches.

21. The corner flashing insert adapted for use only with a recessed window opening structure in accordance with claim 15, wherein a. said recessed jamb leg in the vertical plane having a width of two and one-half (2-½) inches; and b. said recessed sill leg in the horizontal plane having a width of two and one-half (2-½) inches.

22. The corner flashing insert adapted only for use with a recessed window opening structure in accordance with claim 15, wherein a. said recessed jamb leg in the vertical plane having a width of four (4) inches; and b. said recessed sill leg in the horizontal plane having a width of four (4) inches.

23. A corner flashing insert adapted only for use with a recessed window opening structure, the corner flashing insert comprising:

a. an outside wall leg in a first vertical plane including:
(i) a vertical portion having a rear surface, and
(ii) a horizontal portion having a rear surface;

c. a recessed jamb leg in a second vertical plane and a recessed sill leg in a horizontal plane, the recessed sill leg in the horizontal plane having a rear surface, the recessed jamb leg in the second vertical plane having a rear surface and having a first vertical height with a first distance from a top of the recessed jamb leg in the second vertical plane to the rear surface of the recessed sill leg in the horizontal plane;

d. a triangular-shaped recessed back leg in a third vertical plane having an angled surface extending from a first back leg location where the angled surface joins the recessed sill leg in the horizontal plane to a second back leg location where the angled surface joins the recessed jamb leg in the second vertical plane, the triangular shaped recessed back leg in the third vertical plane having a first angle less than ninety (90) degrees relative to the recessed sill leg in the horizontal plane at the first back leg location and having a second angle less than ninety (90) degrees relative to the recessed jamb leg in the second vertical plane at the second back leg location, the triangular-shaped recessed back leg in the third vertical plane having a second vertical height extending from the second back leg location to the rear surface of the recessed sill leg in the horizontal plane, said triangular-shaped recessed back leg in the third vertical plane having a rear surface;

e. said first vertical height greater than said second vertical height by an extra distance, the extra distance extending for a width of said recessed jamb leg in the second vertical plane and further extending for a width of said vertical portion of said outside wall leg in a vertical plane; and f. a combination of said outside wall leg in said first vertical plane, said recessed jamb leg in said second vertical plane, said recessed sill leg in said horizontal plane and said triangular-shaped recessed back leg in said third vertical plane form the corner flashing insert in one piece.

* * * * *